US006876347B2

(12) United States Patent
Tashiro et al.

(10) Patent No.: US 6,876,347 B2
(45) Date of Patent: Apr. 5, 2005

(54) LIQUID CRYSTAL DISPLAY DEVICE

(75) Inventors: Tomohiro Tashiro, Kumamoto (JP); Seiki Takahashi, Kumamoto (JP); Shiro Miyake, Kumamoto (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 408 days.

(21) Appl. No.: 09/962,599

(22) Filed: Sep. 26, 2001

(65) Prior Publication Data

US 2002/0057249 A1 May 16, 2002

(30) Foreign Application Priority Data

Sep. 27, 2000 (JP) ..... P2000-293407

(51) Int. Cl.[7] ..... G00G 3/36
(52) U.S. Cl. ..... 345/87; 345/89; 345/690
(58) Field of Search ..... 345/87, 88, 89, 345/95, 96, 97, 98, 99, 100, 101, 690, 208, 209, 210

(56) References Cited

U.S. PATENT DOCUMENTS 5,657,041 A * 8/1997 Choi ..... 345/99
5,920,298 A * 7/1999 McKnight ..... 345/87
6,144,353 A * 11/2000 McKnight ..... 345/94
6,232,942 B1 * 5/2001 Imoto et al. ..... 345/97
6,304,304 B1 * 10/2001 Koma ..... 349/33
2001/0040546 A1 * 11/2001 Ohmuro et al. ..... 345/87

FOREIGN PATENT DOCUMENTS

JP 60-247378 12/1985
JP 6-27901 2/1994

* cited by examiner

*Primary Examiner*—Xiao Wu
(74) *Attorney, Agent, or Firm*—McDermott Will & Emery LLP

(57) ABSTRACT

In a liquid crystal display device of the invention, a reference voltage having a maximum value higher than a maximum value of a signal voltage used for obtaining a predetermined liquid crystal application voltage-luminance characteristic and a minimum value lower than a minimum value of the signal voltage is formed, and a liquid crystal driving circuit forms a correction voltage to speed up a response of a liquid crystal element from this reference voltage, so that the speed of the response of the liquid crystal element is made high even at the time of change from a gray level to white or black.

7 Claims, 6 Drawing Sheets

PRIOR ART

PRIOR ART

PRIOR ART

LIQUID CRYSTAL DISPLAY DEVICE

BACKGROUND OF THE INVENTION

1. Field of the Invention

The present invention relates to a liquid crystal display device including liquid crystal elements in which a liquid crystal driving circuit is improved.

2. Description of the Related Art

In a normal active matrix type liquid crystal display device, a scanning period of one screen (one frame) is approximately 50 Hz to 75 Hz (13.3 msec to 20 msec). On the other hand, an optical response of a liquid crystal molecule requires a time of several tens msec. Thus, in the case where moving pictures such as TV are displayed on the liquid crystal display device, the response of the liquid crystal element can not follow the change of display data and there arises a disadvantage that a residual image is produced.

Conventionally, as one of measures to the residual image, a measure in which attention is paid to the application voltage dependency of the response speed of the liquid crystal molecule has been taken.

FIG. 4 is a schematic view showing a relation between a liquid crystal application voltage (signal voltage) and a liquid crystal response (luminance change) in a conventional liquid crystal display device of a normally white mode.

In FIG. 4, reference numeral 1 designates a liquid crystal application voltage (signal voltage) when the change of the application voltage is small; 2, a liquid crystal application voltage (signal voltage) when the change of the application voltage is large; 3, a luminance change when the liquid crystal application voltage (signal voltage) 1 is applied; and 4, a luminance change of the liquid crystal element when the liquid crystal application voltage (signal voltage) 2 is applied.

FIG. 5 is a schematic view showing a relation between a liquid crystal application voltage and a response of the liquid crystal element (luminance change) using a conventional Overdrive Method.

In FIG. 5, reference numerals 1 and 3 designates the same as those in FIG. 4. Reference numeral 5 designates a liquid crystal application voltage (correction voltage) applied prior to the liquid crystal application voltage (signal voltage) 1 in order to speed up the response of the liquid crystal element to the liquid crystal application voltage (signal voltage) 1; and 6, a luminance change responding to the liquid crystal application voltage (correction signal) 5.

FIG. 6 is a view showing a gray level-luminance characteristic of a conventional liquid crystal display device of 8-bit (256 levels) display.

In FIG. 6, reference numeral 7 designates a gray level-luminance characteristic.

FIG. 7 is a view showing a liquid crystal application voltage-luminance characteristic of a conventional liquid crystal display device of 8-bit (256 levels) display.

In FIG. 7, reference numeral 8 designates the liquid crystal application voltage-luminance characteristic. Besides, symbol NUR designates a normal use range.

Next, an operation will be described.

FIG. 4 is based on the liquid crystal display device of the normally white mode in which a white display is carried out in a state where an effective voltage is not applied to the liquid crystal element. As shown in FIG. 4, when the liquid crystal application voltage (signal voltage) 1 or 2 is changed, the liquid crystal element starts to respond as indicated by the luminance change 3 or 4, and like the liquid crystal application voltage (signal voltage) 2 and the luminance change 4, the larger the amount of change of the liquid crystal application voltage (signal voltage) is, the shorter the time until the response is completed is. That is, the response of the liquid crystal element between white and black is quick as compared with the response of the liquid crystal element between gray levels. Then, as shown in FIG. 5, in the case where a dark gray level is changed to a bright gray level, a voltage lower than a steady voltage after the change is temporarily applied like the liquid crystal application voltage (correction voltage) 5, and the optical response of the liquid crystal element is made quick like the luminance change 6. In the case where a bright gray level is changed to a dark gray level, a voltage higher than a steady voltage after the change is temporarily applied to speed up the optical response of the liquid crystal element. The liquid crystal response property between gray levels can be improved by correcting the liquid crystal application voltage like this.

In order to realize 8-bit (256 levels) multi-gray levels as shown in FIG. 6, positive and negative reference voltages of approximately 10 to 18 levels in total are normally inputted to a liquid crystal driving circuit, voltages between the respective reference voltages are divided by the liquid crystal driving circuit on the basis of the reference voltages, output voltages of 256 levels are generated in the respective polarities, and an output voltage corresponding to inputted data is selected and is outputted.

Reference symbols V0 to V17 of the liquid crystal application voltage-luminance characteristic 8 of FIG. 7 designate reference voltages inputted to the liquid crystal driving circuit in order to realize the gray level-luminance characteristic 7 of FIG. 6. Among these reference voltages, V8(P)/V9(N) corresponding to a white display is set to a voltage at which the relative luminance becomes approximately 100%, and V0(P)/V17(N) corresponding to a black display is set to a voltage at which a sufficient contrast ratio can be obtained. Here, characters (P) and (N) mean (Positive) and (Negative), and express a positive reference voltage and a negative reference voltage, respectively.

In the conventional reference voltage setting like this, in the case where a gray level is changed from a bright gray level to a gray level close to a saturated gray level (hereinafter referred to as "white", 255 level in eight bits), a voltage value which can be selected as a correction value of the liquid crystal application voltage is a white level one at the minimum, and there is a gray level in which the correction voltage is insufficient so that the speed of a liquid crystal response property can not be made high. Also in the case where a gray level is changed from a dark gray level to a gray level close to 0 level (hereinafter referred to as "black"), since a voltage value which can be selected as a correction value of the liquid crystal application voltage is a black level one at the maximum, a similar problem arises.

SUMMARY OF THE INVENTION

The present invention has been made to solve the foregoing problem, and an object thereof is to provide a liquid crystal display device in which visibility at a time of display of moving pictures between gray levels is improved even in a case where a gray level change is slight.

A liquid crystal display device including liquid crystal elements according to the present invention carries out a display corresponding to an inputted image signal, in which a liquid crystal driving circuit for supplying a voltage to each of the liquid crystal elements supplies a signal voltage corresponding to the inputted image signal and a correction voltage for speeding up a response speed of each of the liquid crystal elements prior to the signal voltage, a maximum value of the correction voltage is set higher than a maximum value of the signal voltage, and a minimum value of the correction voltage is set lower than a minimum value of the signal voltage.

The liquid crystal display device according to the present invention, in which the maximum value of the correction voltage is set higher than the maximum value of the signal voltage, and the minimum value of the correction voltage is set lower than the minimum value of the signal voltage, even in the case where the signal voltage change is slight, whereby it is possible to speed up the response of each of the liquid crystal elements.

Furthermore, a liquid crystal display device including liquid crystal elements according to the present invention carries out a display corresponding to an inputted image signal, in which a liquid crystal driving circuit for supplying a voltage to each of the liquid crystal elements supplies a signal voltage corresponding to the inputted image signal and a correction voltage for speeding up a response speed of each of the liquid crystal elements prior to the signal voltage, and the liquid crystal driving circuit includes a first reference voltage used for supplying the signal voltage and a second reference voltage used for supplying the correction voltage, a maximum value of the second reference voltage is higher than a maximum value of the first reference voltage, and a minimum value of the second reference voltage is lower than a minimum value of the first reference voltage.

The liquid crystal display device according to the present invention, in which the liquid crystal driving circuit includes the first reference voltage used for supplying the signal voltage and the second reference voltage used for supplying the correction voltage, the maximum value of the second reference voltage is higher than the maximum value of the first reference voltage, and the minimum value of the second reference voltage is lower than the minimum value of the first reference voltage, whereby even in the case where the signal voltage change is slight, it is possible to speed up the response of each of the liquid crystal elements.

Besides, the liquid crystal display device of the present invention has a configuration, wherein the liquid crystal driving circuit includes a terminal to which the second reference voltage is inputted and a terminal to which a control signal to select one of the first reference voltage and the second reference voltage is inputted.

By this configuration, the second reference voltage can be selected when necessary and can be used.

Furthermore, the liquid crystal display device of the present invention has a configuration, wherein the second reference voltage is supplied at a time when the signal voltage is changed to one of its maximum value and minimum value.

By this configuration, even in the case where a signal voltage change is slight, it is possible to speed up the liquid crystal response.

Furthermore, the liquid crystal display device of the present invention has a configuration, wherein the second reference voltage is supplied which has such a value that when the signal voltage is changed to one of the maximum value and the minimum value, the luminance of each of liquid crystal elements corresponding to the signal voltage is not distorted.

By this configuration, the second reference voltage does not have a bad influence on display quality.

DETAILED DESCRIPTION OF THE PREFERRED EMBODIMENTS

First Embodiment

Figure 1:
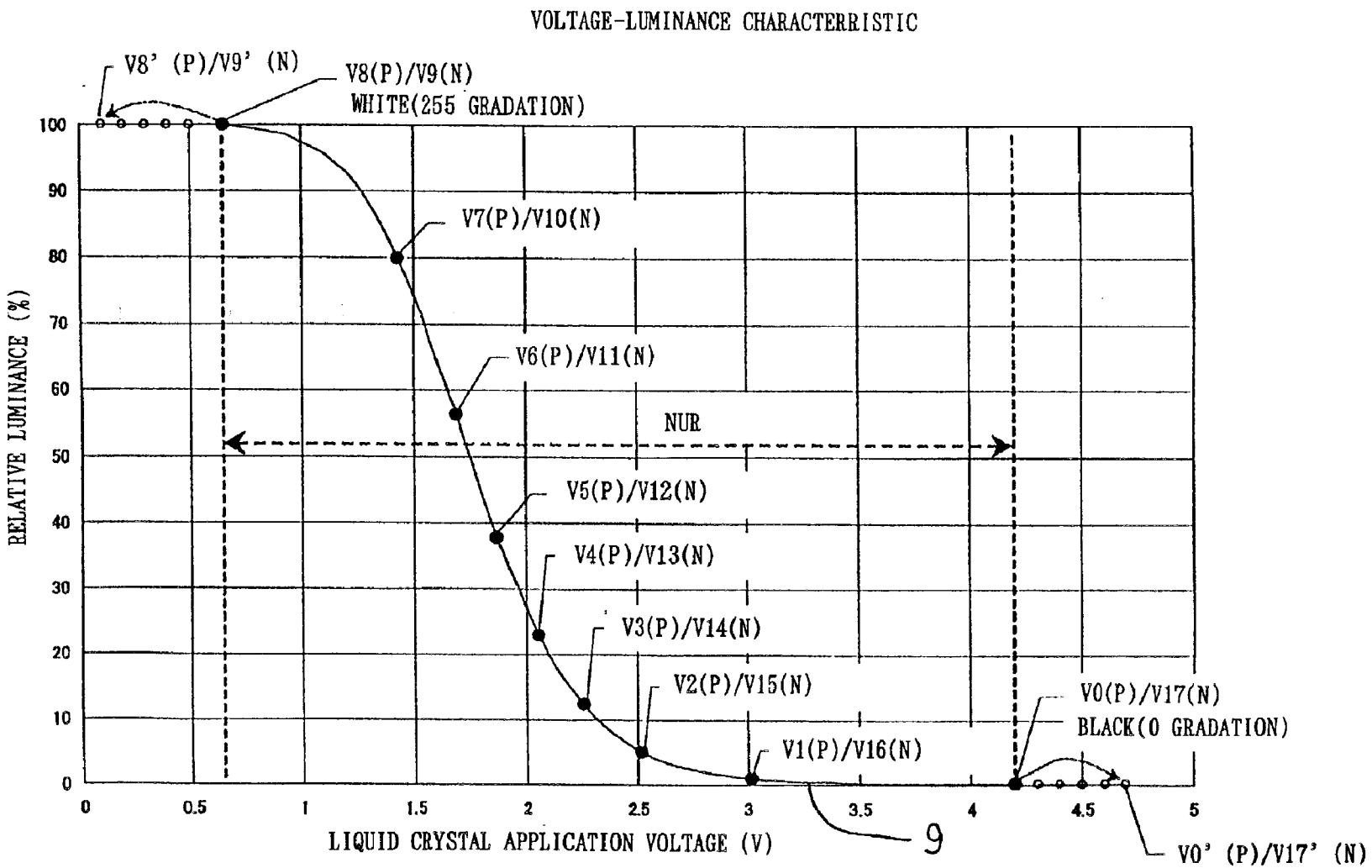
FIG. 1 is a view showing a liquid crystal application voltage-luminance characteristic of a liquid crystal display device according to a first embodiment of the present invention.

FIG. 1 is a view showing a liquid crystal application voltage-luminance characteristic of a liquid crystal display device according to a first embodiment of the present invention.

In FIG. 1, reference numeral 9 designates a liquid crystal application voltage-luminance characteristic of each of liquid crystal elements constituting the liquid crystal display device.

In FIG. 1, a reference voltage V8(P)/V9(N) corresponding to white is shifted to a low voltage side as indicated by V8'(P)/V9'(N). Besides, a reference voltage V0(P)/V17(N) corresponding to black is shifted to a high voltage side as indicated by V0'(P)/V17'(N). Incidentally, characters (P) and (N) mean (Positive) and (Negative), and express a positive reference voltage and a negative reference voltage, respectively.

In the liquid crystal display device according to the first embodiment, while a liquid crystal application voltage (signal voltage) at which luminance corresponding to an inputted image signal can be obtained is supplied to each of the liquid crystal elements by a liquid crystal driving circuit, the shifted reference voltage as shown in FIG. 1 is used, and the liquid crystal driving circuit supplies a correction voltage to each of the liquid crystal elements prior to the supply of the liquid crystal application voltage (signal voltage) at which luminance corresponding to the inputted image signal can be obtained. By this, even at the time of change from a gray level to a gray level close to white or black, the liquid crystal application voltage becomes high unlike the prior art, and it becomes possible to speed up the liquid crystal response to luminance change toward the vicinity of white or black.

Besides, in the inside of the liquid crystal driving circuit, since the reference voltages are divided as described above, the voltage between V7(P)/V10(N) and V8'(P)/V9'(N) is divided. The state is shown by white dot marks in FIG. 1.

In the first embodiment, with respect to the luminance change toward the vicinity of white like this, an optimum level among the white dot marks can be selected from the relation between the luminance of the previous screen and the luminance of the present screen. The same applies to V1(P)/V16(N) and V0'(P)/V17'(N) at the black side. Incidentally, symbol NUR in FIG. 1 designates a normal use range.

According to the first embodiment, an existing liquid crystal driving driver IC can be used, and even in the case where a luminance change is slight, the visibility of transition between different gray levels on moving pictures can be improved. Thus, with respect to the luminance of white and black, a gray level-luminance characteristic without a difference in superiority and equivalent or almost equivalent to the prior art can be obtained, and further, the visibility at the time of display of moving pictures between a rather bright gray level and a brighter gray level or between a rather dark gray level and a darker gray level can be improved.

Second Embodiment

Figure 2:
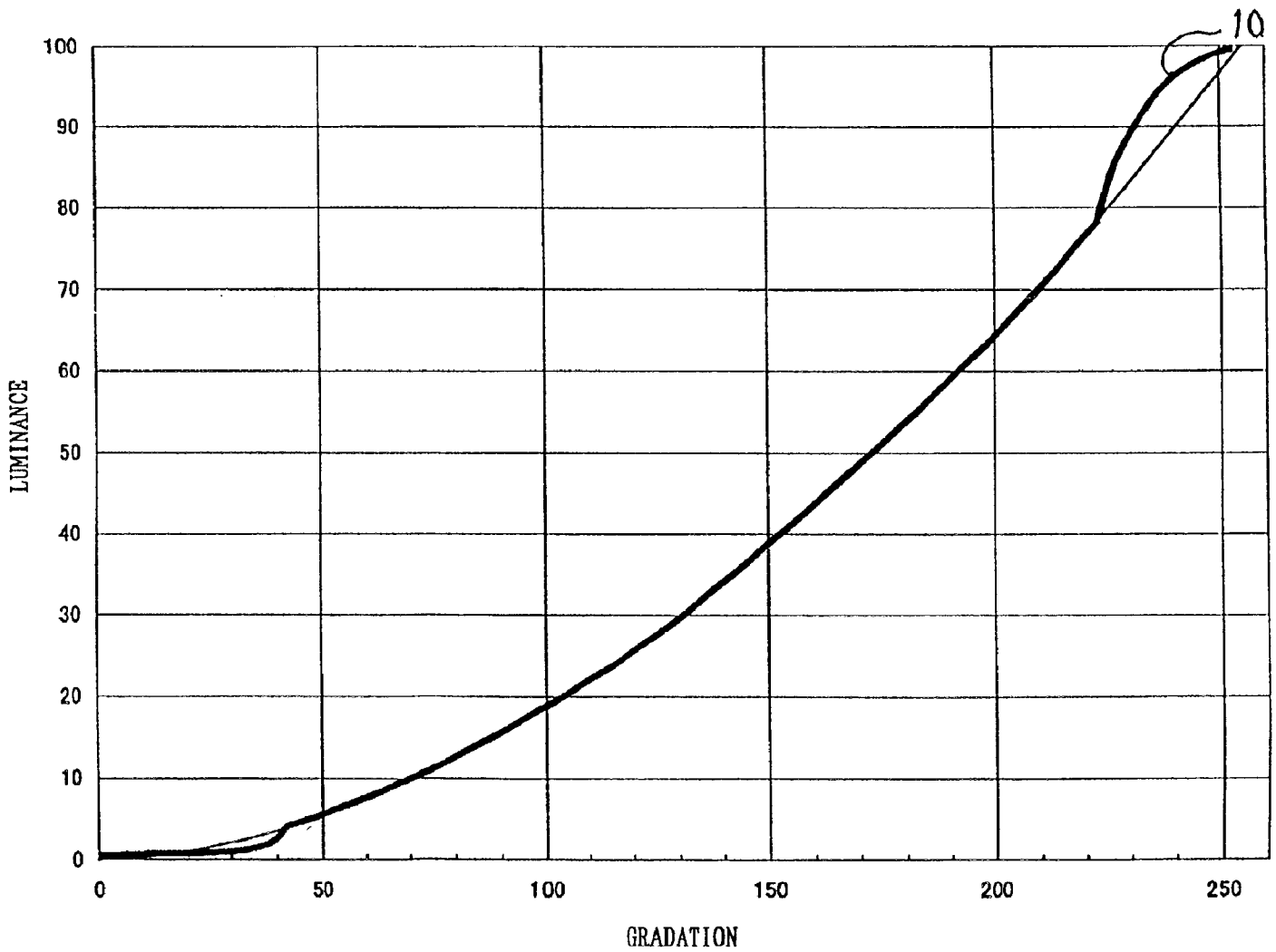
FIG. 2 is a view for explaining an improvement in a gray level-luminance characteristic of a liquid crystal display device according to a second embodiment of the present invention.

FIG. 2 is a view for explaining an improvement in a gray level-luminance characteristic of a liquid crystal display device according to a second embodiment of the present invention.

In FIG. 2, reference numeral 10 designates a gray level-luminance characteristic.

Figure 3:
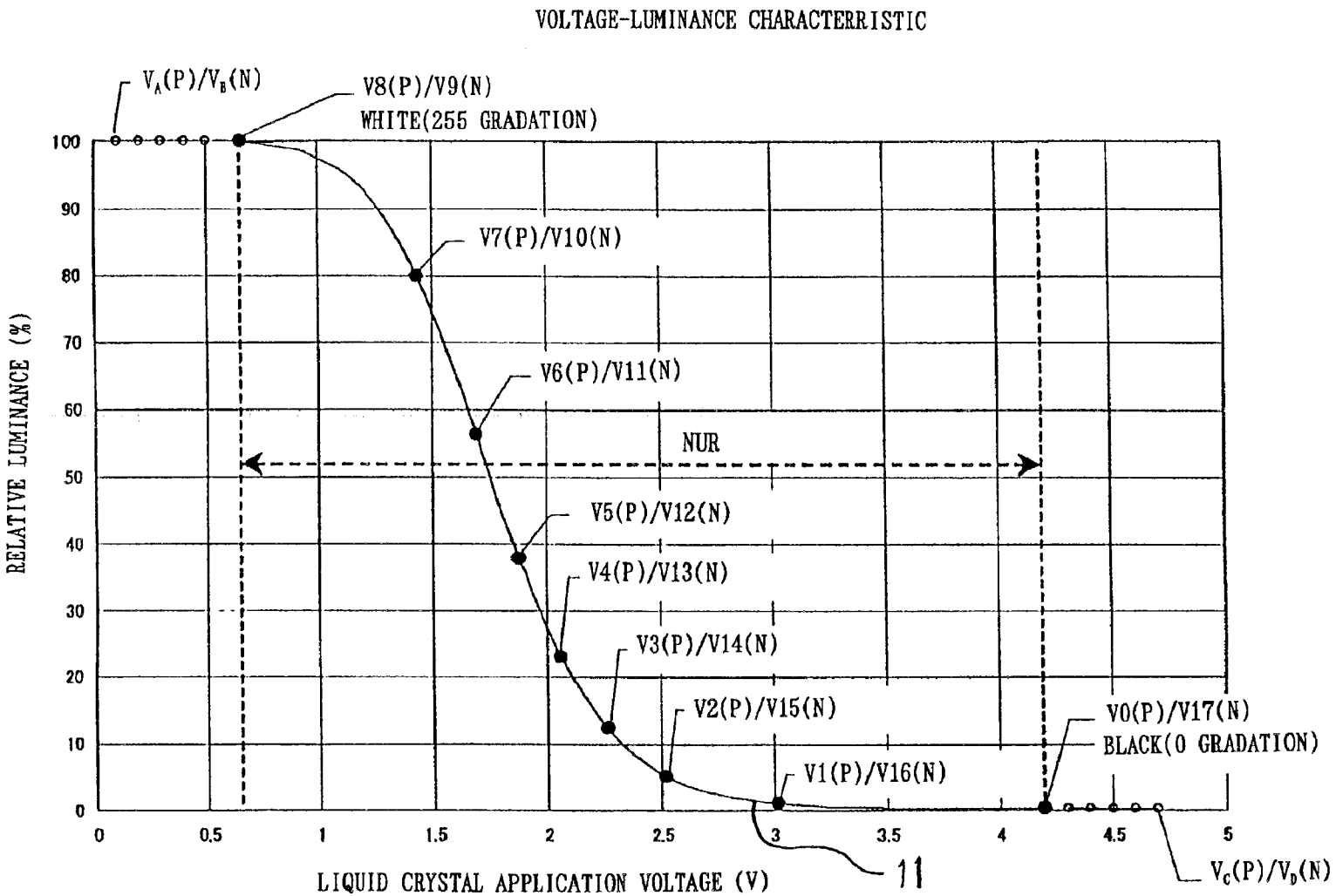
FIG. 3 is a view showing a liquid crystal application voltage-luminance characteristic of the liquid crystal display device according to the second embodiment of the present invention.
Figure 4:
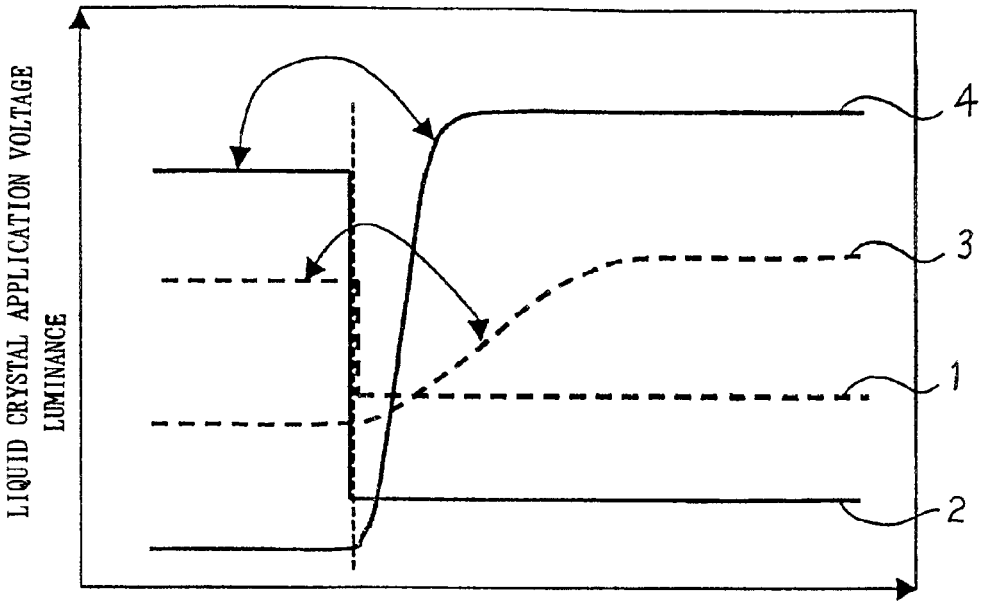
FIG. 4 is a schematic view showing a relation between a liquid crystal application voltage (signal voltage) and a liquid crystal response (luminance change) in a conventional liquid crystal display device of a normally white mode.
Figure 5:
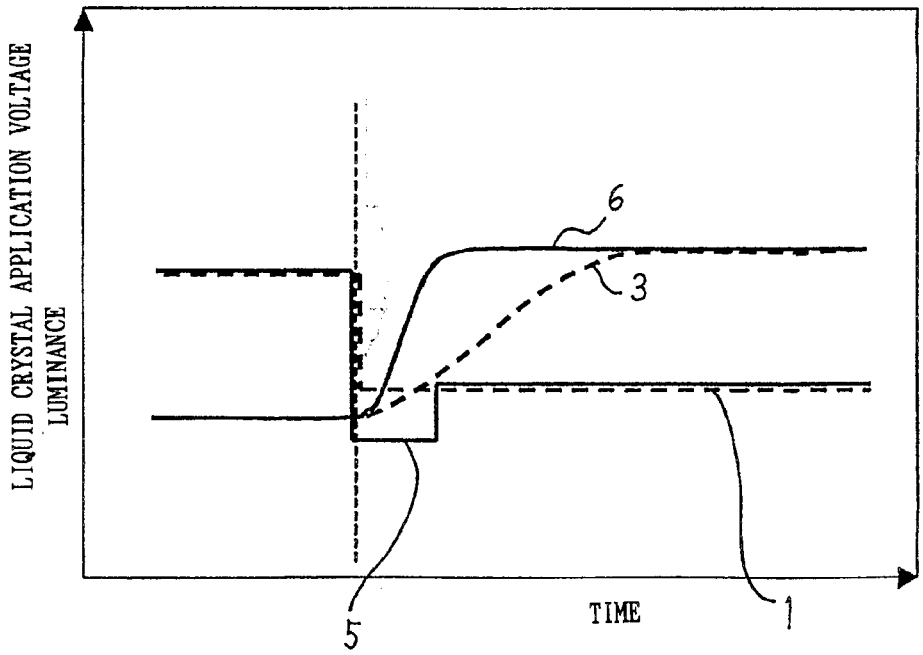
PRIOR ART Fig. 5
FIG. 5 is a schematic view showing a relation between a liquid crystal application voltage and a liquid crystal response (luminance change) using a conventional Over-drive Method.
Figure 6:
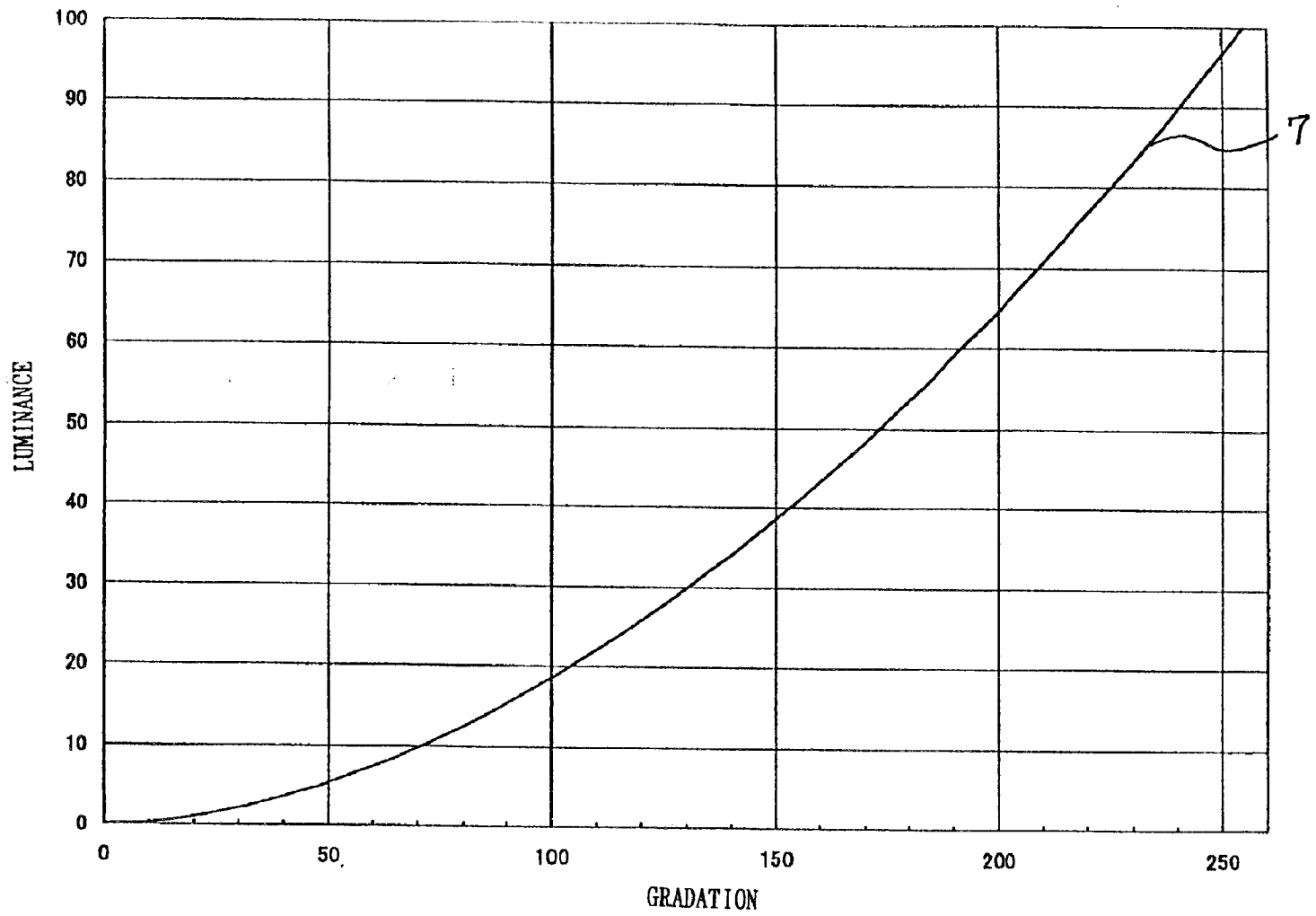
FIG. 6 is a view showing a gray level-luminance characteristic of a conventional liquid crystal display device of 8-bit display (256 levels).
Figure 7:
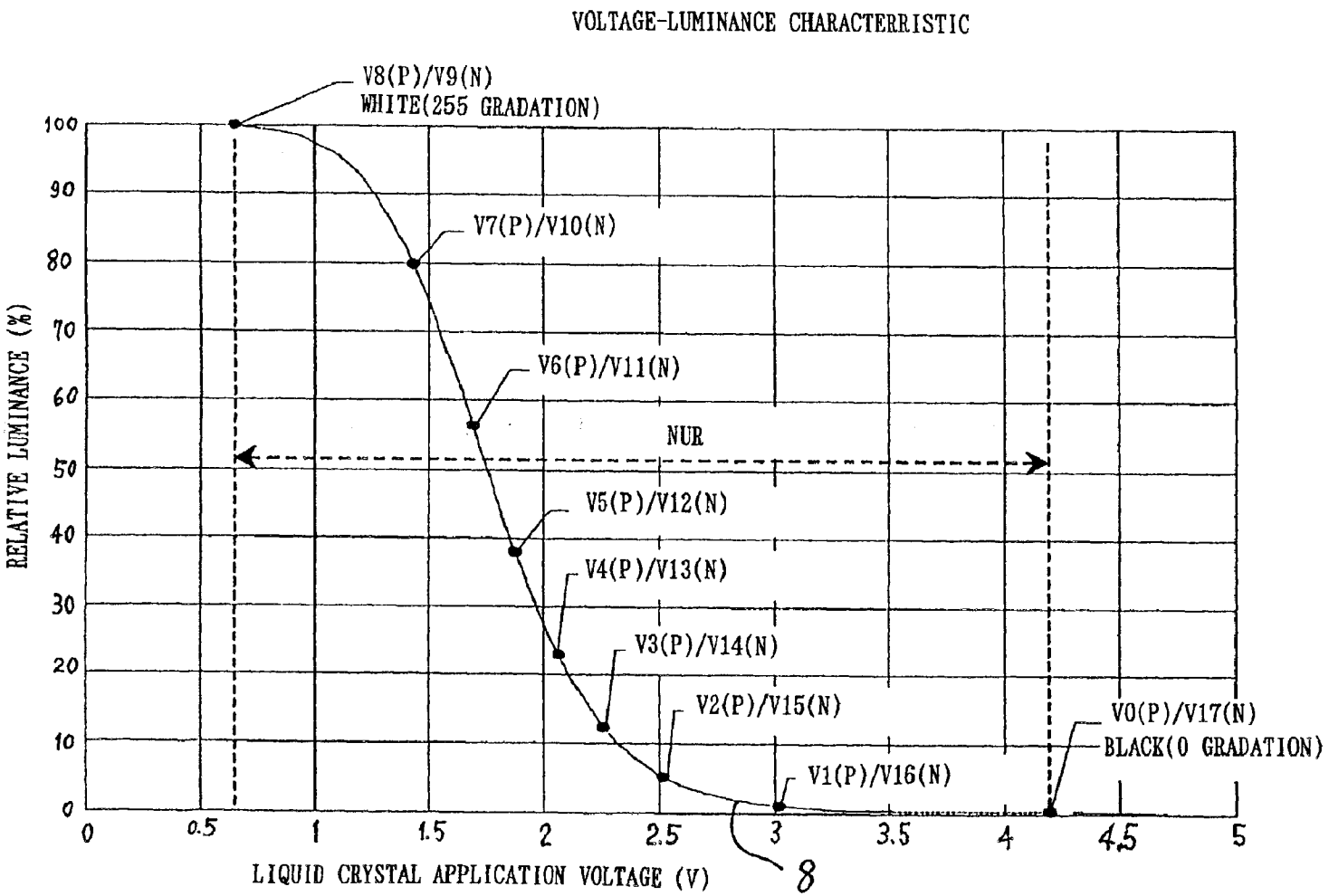
FIG. 7 is a view showing a liquid crystal application voltage-luminance characteristic of a conventional liquid crystal display device of 8-bit display (256 levels).

FIG. 3 is a view showing a liquid crystal application voltage-luminance characteristic of the liquid crystal display device according to the second embodiment of the present invention. Incidentally, symbol NUR designates a normal use range.

In FIG. 3, reference numeral 11 designates a liquid crystal application voltage-luminance characteristic.

In the first embodiment, since the voltage values of black and white are shifted, at gray levels (levels between V0/V17–V1/V16 and between V8/V9–V7/V10) of the vicinity of black and white calculated from voltage values of black and white levels, the gray level-luminance characteristic in the vicinity of black and white is influenced by the shift and is slightly distorted like the gray level-luminance characteristic 10 of FIG. 2. In order to eliminate this distortion, according to the second embodiment, in order to speed up the liquid crystal response without changing the luminance of a gray level in the vicinity of black and white, in addition to reference voltages of V0 to V17 as first reference voltages for obtaining a predetermined liquid crystal application voltage-luminance characteristic, reference voltages for correction voltages ($V_A$(P), $V_B$(N), $V_C$(P), $V_D$(N) ) are provided as second reference voltages used for speeding up the response of liquid crystal element.

FIG. 3 shows the liquid crystal application voltage-luminance characteristic 11 in the second embodiment. In the second embodiment, a signal line driving circuit is provided with an input terminal of reference voltage for correction voltage and a control input terminal for indicating which of a conventional gray level voltage and the newly provided reference voltage for the correction voltage is selected as an output voltage. By this, at the time of change toward the vicinity of white, $V_A/V_B$ is selected and is outputted by a control signal, so that the speed of the liquid crystal response can be made high. The same applies to the change toward the vicinity of black.

Further, as shown in FIG. 3, the voltage between $V_A/V_B$ and V8/V9 is divided to enable selection of one of white dot marks. Thus, similarly to the first embodiment, with respect to luminance change toward the vicinity of white, an optimum level among the white dot marks can be selected from the relation between the luminance of a previous screen and the luminance of a present screen. The same applies to the voltage between $V_C/V_D$ and V0/V17 at the black side.

According to the second embodiment, without changing the gray level-luminance characteristic, even in the case where a gray level change is slight, the visibility at the time of display of moving pictures between gray levels can be improved. With respect to the luminance of white and black, the gray level-luminance characteristic 11 without a difference in superiority and equivalent or almost equivalent to the prior art can be obtained, and further, the visibility at the time of display of moving pictures between a rather bright gray level and a brighter gray level or between a rather dark gray level and a darker gray level can be improved.

What is claimed is:

1. A liquid crystal display device for displaying an image based on an image signal, comprising:

a display unit including liquid crystal and having predetermined liquid crystal applied voltage-luminance characteristics, in which a luminance according to the image data varies depending on a liquid crystal applied voltage applied to the display unit; and a signal line drive circuit that is selectively inputted with a first reference voltage used for supplying the liquid crystal applied voltage to the display unit, and a second reference voltage having a maximum value larger than a maximum value of the liquid crystal applied voltage and a minimum value smaller than a minimum value of the liquid crystal applied voltage; supplies the liquid crystal applied voltage to the display unit based on the first reference voltage; and when the liquid crystal applied voltage is changed to the maximum value or the minimum value, supplies a correction voltage to the display unit based on the second reference voltage for speeding up a response of the liquid crystal, the correction voltage being higher than the maximum value or lower than the minimum value of the liquid crystal applied voltage.

2. The liquid crystal display device according to claim 1, wherein the signal line drive circuit includes a terminal to which the second reference voltage is inputted and a terminal to which a control signal to select one of the first reference voltage and the second reference voltage is inputted.

3. The liquid crystal display device according to claim 1, wherein a value of the second reference voltage is selected such that when the liquid crystal applied voltage is changed to the maximum value or the minimum value, the luminance corresponding to the liquid crystal applied voltage is not distorted.

4. The liquid crystal display device according to claim 2, wherein a value of the second reference voltage is selected such that when the liquid crystal applied voltage is changed to the maximum value or the minimum value, the luminance corresponding to the liquid crystal applied voltage is not distorted.

5. The liquid crystal display device according to claim 1, wherein the correction voltage is supplied before the liquid crystal applied voltage corresponding to the image signal is supplied.

6. The liquid crystal display device according to claim 2, wherein the correction voltage is supplied before the liquid crystal applied voltage corresponding to the image signal is supplied.

7. The liquid crystal display device according to claim 3, wherein the correction voltage is supplied before the liquid crystal applied voltage corresponding to the image signal is supplied.

* * * * *